US010112293B2

(12) United States Patent
Cheng

(10) Patent No.: US 10,112,293 B2
(45) Date of Patent: Oct. 30, 2018

(54) MULTIFUNCTIONAL TOOL SET

(71) Applicant: KANTAS PRODUCTS CO., LTD., Taipei (TW)

(72) Inventor: Yang-Fu Cheng, Taipei (TW)

(73) Assignee: KANTAS PRODUCTS CO., LTD., Taipei (TW)

( * ) Notice: Subject to any disclaimer, the term of this patent is extended or adjusted under 35 U.S.C. 154(b) by 197 days.

(21) Appl. No.: 15/342,166

(22) Filed: Nov. 3, 2016

(65) Prior Publication Data

US 2018/0056495 A1 Mar. 1, 2018

(30) Foreign Application Priority Data

Aug. 29, 2016 (TW) ..... 105213161 U

(51) Int. Cl.
*B25F 1/02* (2006.01)
*B25B 13/04* (2006.01)
*B25B 15/00* (2006.01)

(52) U.S. Cl.
CPC ..... *B25F 1/02* (2013.01); *B25B 13/04* (2013.01); *B25B 15/008* (2013.01)

(58) Field of Classification Search
CPC ... B25B 15/005; B25B 15/007; B25B 15/008; B25B 13/04; B25B 13/06; B25B 13/08; B25F 1/00; B25F 1/02
See application file for complete search history.

(56) References Cited

U.S. PATENT DOCUMENTS 5,655,242 A * 8/1997 Chuang ..... B25B 13/04 7/100
6,637,061 B1 * 10/2003 Spracklin ..... B25B 13/48 7/138
7,698,970 B1 * 4/2010 Chavez ..... B25B 13/04 7/138
D709,344 S * 7/2014 Adelman ..... B25B 15/00 D3/208
9,840,001 B2 * 12/2017 Neubauer ..... B25F 1/02
9,975,234 B2 * 5/2018 Berman ..... B25F 1/04
2014/0143958 A1 * 5/2014 Barr ..... B25F 1/00 7/138

* cited by examiner

*Primary Examiner* — David B Thomas
(74) *Attorney, Agent, or Firm* — Bacon & Thomas, PLLC

(57) ABSTRACT

The present invention is to provide a multifunctional tool set which has functions of wrenches and screwdrivers and is easy to carry and includes a plate, a fixing device and screwdrivers with screwdriver heads in different specifications. The plate has a through hole cut therethrough, and first and second stepped portions, wherein the first and second flat portions are formed on an inside wall of the through hole. The stepped portions correspond in position to the flat portions respectively, so as to form the wrench holes with different imperial and metric dimensions. The fixing device has assembly holes cut therethrough and configured for insertion of the screwdrivers, and a lower portion more forwardly protruding than an upper portion thereof for matching with the through hole. Therefore, the fixing device can be mounted into the through hole by a deformation manner and the screwdrivers are positioned in parallel to both sides of the plate.

6 Claims, 4 Drawing Sheets

MULTIFUNCTIONAL TOOL SET

FIELD OF THE INVENTION

The present invention relates to a multifunctional tool set which has functions of wrenches and screwdrivers and is easy to carry, more particularly to a multifunctional tool set in which a plate has a through hole cut therethrough, and a first stepped portion, a second stepped portion, a first flat portion, and a second flat portion formed on an inside wall of, the through hole so as to form the wrench holes having different imperial and metric dimensions respectively between one of the stepped portions and one of the flat portions corresponding in position to each other; the multifunctional tool set further includes a fixing device having a lower portion more forwardly protruding than an upper portion thereof, such that the fixing device can be mounted into the through hole and a plurality of screwdrivers can be inserted into assembly holes of the fixing device to be assembled with the plate integrally; furthermore, after unloading the fixing device and the screwdrivers from the plate, the user can rotate a nut by one of the wrench holes having a dimension matching with a size of the nut.

BACKGROUND OF THE INVENTION

In recent years, with progresses of technology and life quality, when purchasing new products, people start to consider all of price, endurability, convenience, accessibility and safety of the new products. Subject to the change of the market trend, the manufacturers in various industries must continuously make in effort to develop newer and more progressive products to meet most customer's requirements. A wrench or screwdriver is an essential tool for people in life. Various tools have different sizes for meeting all possible requirements, as a result, commercially available tools are usually grouped as a set for sale; however, it is not inconvenient for user to stow or carry the tool set.

In addition, different countries may regulate different dimension units. Currently, most popular dimension units include "metric unit" and "imperial unit" which are in units of cm and inch, respectively. A hex nut is taken as an example, metric dimensions of the hex nuts may include 6 mm, 8 mm, 10 mm, and 12 mm (or cm), and imperial dimensions of the hex nut may include 1/16, 5/64, 3/32, and 1/8 (inch). Subject to different dimension units, when the user goes outdoor and possibly is required to fix or detach device, and user must consider to carry suitable tools in which dimension units and which sizes for meeting various possible requirements for fixing or detaching, so as to not carry too heavy load. If the user carries many kinds of tools, it is a very heavy load for the user; otherwise, if the user carries few kinds of tools, the user is unable to operate the nut with dimension not matching with the carried tools. Hence, under a condition that the conventional tools are in a variety of types and different dimensions, it is not convenient for the user to carry suitable tools for meeting possible requirement.

Currently, there is a multifunctional tool set which is commercially available, the tool set includes a plate, and multiple tool heads (such as a wrench, a crowbar, a bottle opener, a screwdriver or a front sight) formed at an outer edge of the plate or inside the plate. Particularly, multiple screwdrivers are mounted in an opening formed on the plate for easy carry, such that the user just carry the multifunctional tool set which has a size of single plate, to meet most situations. However, the multifunctional tool set can integrate multiple functions in the single plate, but it still has deficiency in use. For example, in order to rotate a nut, a wrench is required for easy to apply force; however, it is impossible to sequentially dispose all imperial and metric dimensions of wrench holes on a periphery of a limited area of the plate; otherwise, the plate with all dimensions of wrench holes may have an excessive area which is disadvantage for carrying. As a result, aforementioned multifunctional tool set can integrate with multiple screwdrivers for easy to carry, but the user is still unable to use the multifunctional tool set to operate all sizes of nuts.

Therefore, what is need is to improve the conventional multifunctional tool set for developing a new structure of tool without increasing its overall area and size, to enable the manufacturer to dispose various dimensions and sizes of wrench holes on the multifunctional tool set and integrate functions of multiple screwdrivers together, such that the new tool set can be easy to carry and used to operate various dimensions of nuts.

SUMMARY OF THE INVENTION

In order to solve the problems caused by different dimensions of various tools, and by difference between imperial units and metric units, the inventor of the present disclosure put years of practical experience into research and design and finally succeeded in developing a multifunctional tool set which use a through hole to implement functions of wrench holes and is easy to carry.

An objective of the present disclosure is to provide a multifunctional tool set including a plate, a fixing device and a plurality of screwdrivers. The plate has a through hole cut through a middle portion thereof, and a first stepped portion, a second stepped portion, a first flat portion and a second flat portion formed on inside wall of the through hole. The front and rear ends of the first and second stepped portions are jointed with the first and second flat portions respectively, the first stepped portion corresponds in position to the first flat portion and the second stepped surface corresponds in position to the second flat portion, so that the through hole has a hole diameter gradually increasing from the front and rear ends thereof to a center portion thereof. The first stepped portion is formed with a plurality of stepped parts which are sequentially jointed in an order from small to large, and the first stepped parts are in parallel with the first flat portion, so as to form different metric dimensions of wrench holes between the first stepped parts and the first flat portion, respectively. The second stepped portion is formed with a plurality of second stepped parts which are sequentially jointed in an order from small to large, the plurality of second stepped part are in parallel with the second flat portion, so as to form different imperial dimensions of wrench holes between the plurality of second stepped parts and the second flat portion. The fixing device is formed by elastic material and has a plurality of assembly holes cut therethrough and in parallel with each other, and a structure of the fixing device matches with that of the through hole, so as to enable the fixing device to be mount in the through hole by a deformation manner, and expose the plurality of assembly holes out of the through hole. The fixing device includes an upper member and a lower member, a bottom of the upper member is jointed with a top of the lower member, and a front end of the lower member is more protruding than a front end of the upper member. The plurality of screwdrivers have sectional structures respectively matching with the plurality of assembly holes of the fixing device, so as to be mounted into the plurality of assembly holes and positioned in parallel with both sides of the plate, and adjacent to the through hole. Therefore, the through hole can be used to fix the fixing device and serve as the wrench hole, so that the multifunctional tool set can integrate functions of the wrench holes and is easy to carry under a premise that the tool set has a light weight and small volume.

BRIEF DESCRIPTION OF THE DRAWINGS

The detailed structure, operating principle and effects of the present disclosure will now be described in more details hereinafter with reference to the accompanying drawings that show various embodiments of the present disclosure as follows.

DETAILED DESCRIPTION OF THE PREFERRED EMBODIMENTS

Figure 1:
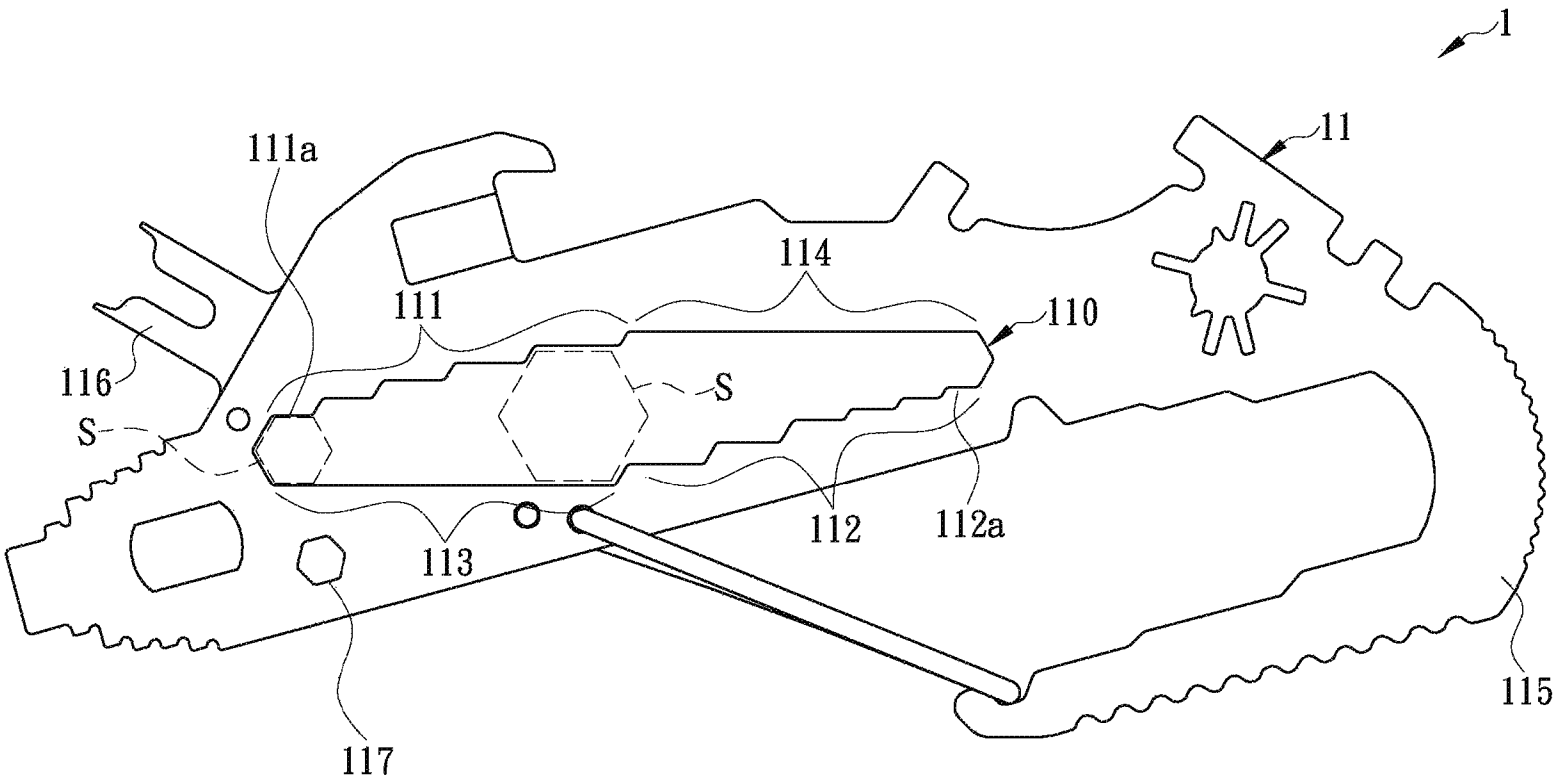
FIG. 1 is a schematic view of a plate of a multifunctional tool set of the present disclosure.

The technical content of the present invention will become apparent by the detailed description of the following embodiments and the illustration of related drawings as follows.

The present invention relates to a multifunctional tool set which uses a through hole to implement functions of wrench holes and is easy to carry. Please refer to FIGS. 1 and 2 which show a first preferred embodiment of the present invention. The multifunctional tool set 1 includes a plate 11, a fixing device 12 and a plurality of screwdrivers 13 (such as hexagon screwdrivers) having screwdriver heads in different specifications. The plate 11 has a through hole 110 cut through a center portion thereof, and the through hole 110 has a slightly-parallelogram structure and two step-shaped side surfaces, such that the plate 11 has a first stepped portion 111, a second stepped portion 112, a first flat portion 113 and a second flat portion 114 formed on the inside wall thereof.

For convenience in explanation of relative locations of structures of the multifunctional tool set 1, left and right sides of FIG. 1 are defined as front and rear ends of the multifunctional tool set 1, respectively. Please refer to FIG. 1. The front and rear ends of the first and second stepped portions 111 and 112 are jointed with the first and second flat portions 113 and 114, respectively. The first stepped portion 111 corresponds in position to the first flat portion (that is, the first stepped portion 111 faces the first flat portion 113, and the first stepped portion 111 and the first flat portion 113 are located at a former half of the through hole 110). The second stepped portion 112 corresponds in position to the second flat portion 114 (that is, the second stepped portion 112 faces the second flat portion 114, and the second stepped portion 112 and the second flat portion 114 are located a latter half of the through hole 110), such that the through hole 110 has a hole diameter increasing from front and rear ends thereof to the center portion thereof.

The first stepped portion 111 is formed by a plurality of first stepped parts 111*a* which are jointed in an order from small to large, and from the front end of the through hole 110 to the center portion of the through hole 110, and each of the plurality of first stepped parts 111*a* is in parallel with the first flat portion 113, such that different metric dimensions (such as 6 mm, 8 mm, 10 mm and 12 mm) of wrench holes S are formed between the plurality of stepped parts 111*a* and the first flat portion, respectively. The second stepped portion 112 is formed by a plurality of second stepped parts 112*a* which are jointed in an order from small to large and from rear end to the center portion of the through hole 110, and each of the plurality of second stepped parts 112*a* is in parallel with the second flat portion 114, such that different imperial dimensions (such as 1/16, 5/64, 3/32 and 1/8) of wrench holes S are formed between the plurality of second stepped parts 112*a* and the second flat portion 114.

Figure 2:
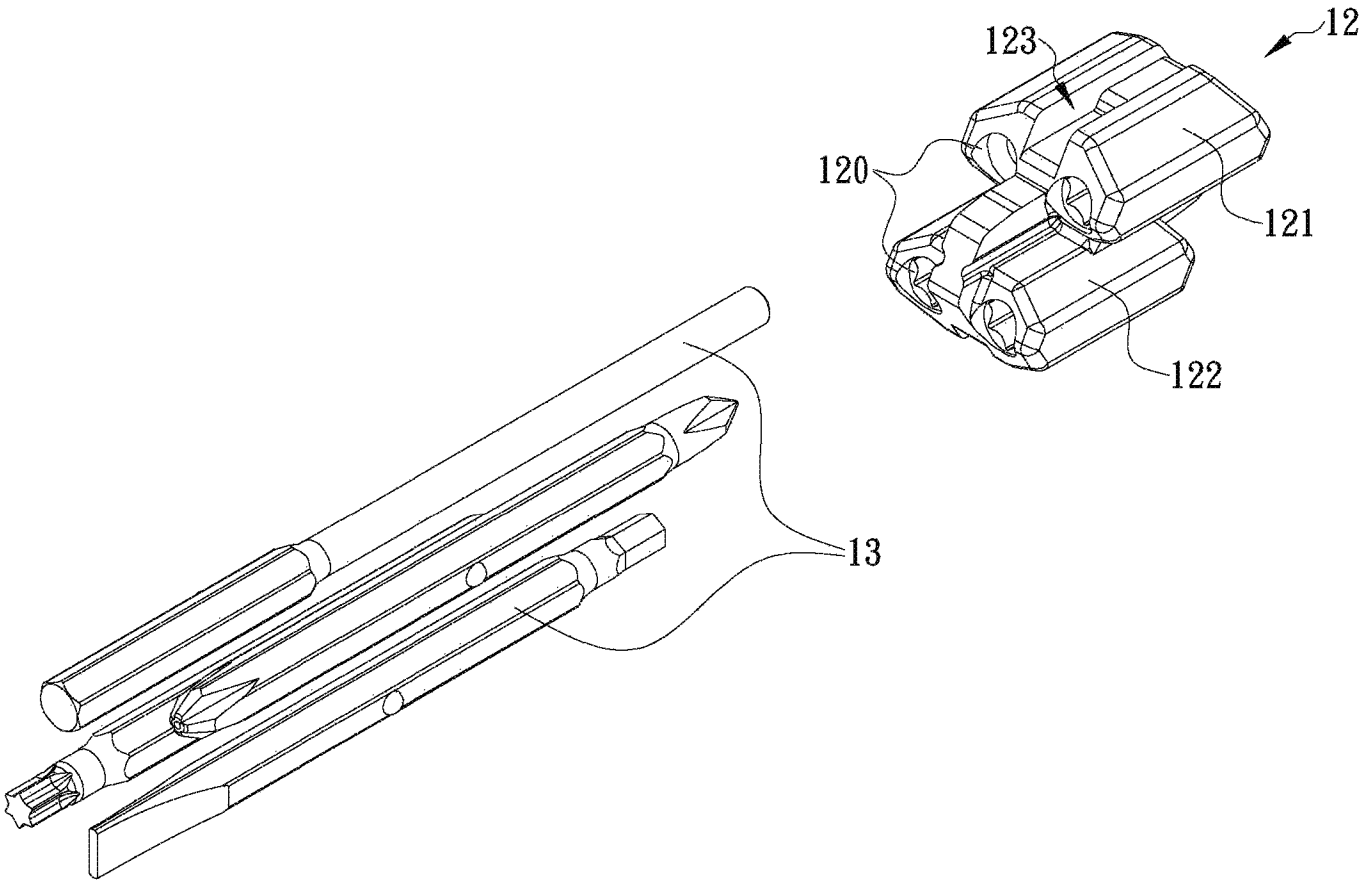
FIG. 2 is a schematic view of a fixing device and a screwdriver of the multifunctional tool set of the present disclosure.
Figure 3:
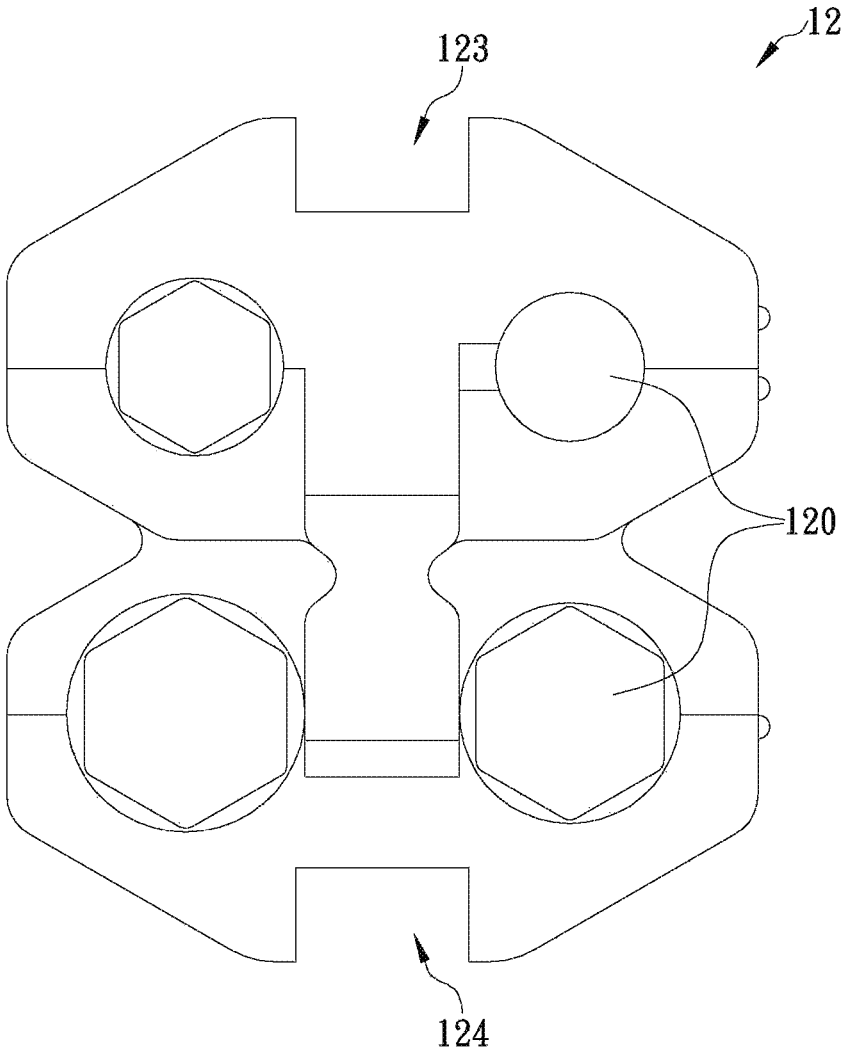
FIG. 3 is a schematic view of a screwdriver of the multifunctional tool set of the present disclosure.
Figure 4:
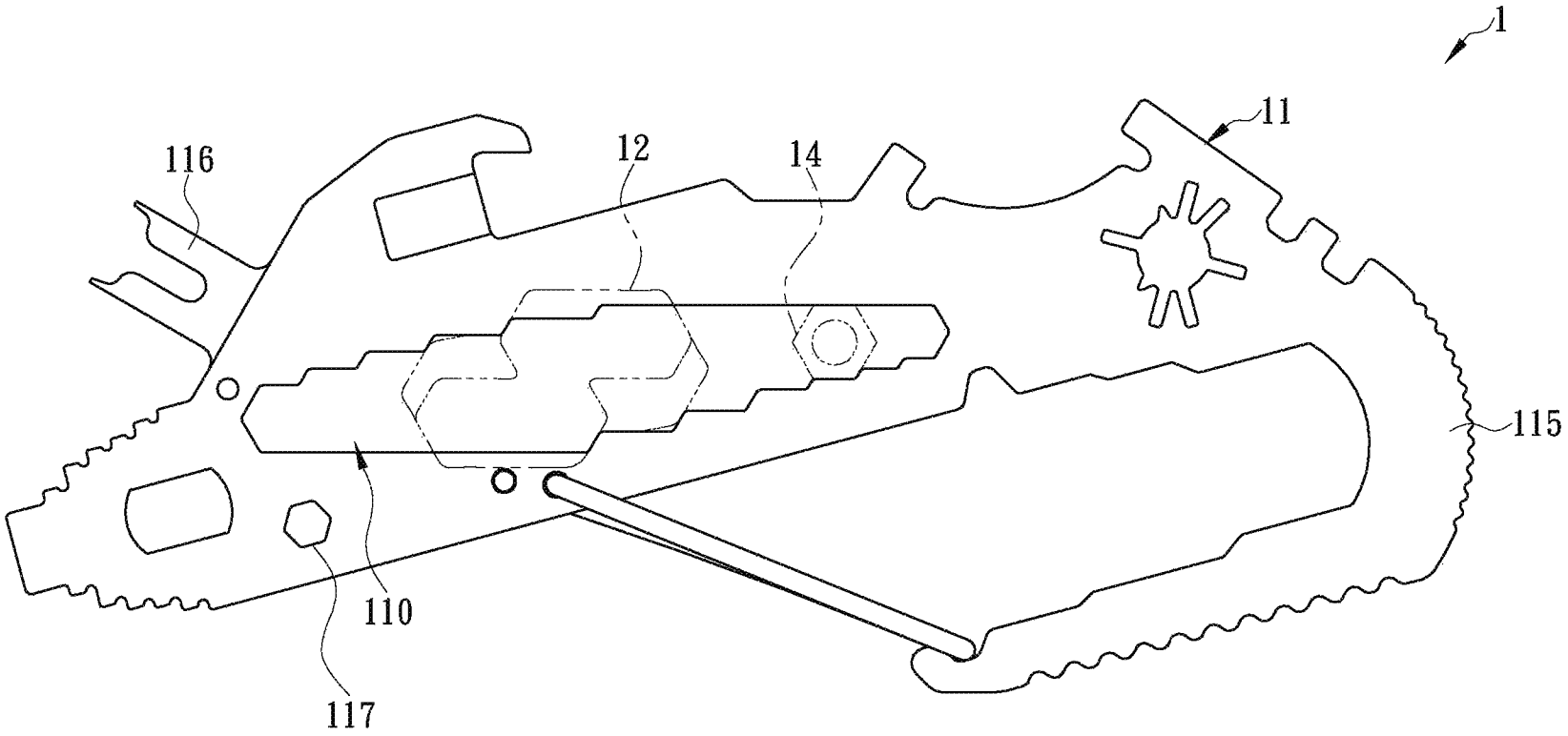
FIG. 4 is a schematic view showing a way of assembling the multifunctional tool set of the present disclosure.

Please refer to FIGS. 1 through 3. The fixing device 12 is made by elastic material (such as rubber), and has a plurality of assembly holes 120 cut therethrough in a longitudinal direction. The plurality of assembly holes 120 are located in parallel with each other, and a structure of the fixing device 12 matches with that of the through hole 110, such that the fixing device 12 can be engaged and fixed in the through hole 110 by a deformation manner; at this time, the plurality of assembly holes 120 are respectively exposed out of the through hole 110.

The plurality of screwdriver 13 have sectional structures, which can be identical to or different from each other, respectively match with the assembly holes 120 of the fixing device 12, so that the plurality of screwdrivers 13 can be inserted into the plurality of assembly holes 120 respectively and positioned in parallel with both sides of the plate 11 and adjacent to the through hole 110. Please refer to FIGS. 1 through 4. The fixing device 12 has the structure matching with a shape of the through hole 110, so the user is able to insert the plurality of screwdrivers 13 into the fixing device 12 and then engage the fixing device 12 into the through hole 110, whereby the plate 11 and the screwdrivers 13 are combined integrally by the fixing device 12, for easy to carry. When the user wants to loosen or tightly lock a nut 14, from the through hole 110, the user can select one of the wrench holes S matching with the nut 14, then engage the selected wrench hole S with the nut 14, and use the plate 11 as a wrench.

The present disclosure uses the unique structure of the through hole 110 of which the inside wall is formed with the plurality of stepped portions 111 and 112 of the plate 11 sequentially according to imperial and metric dimensions. The stepped parts 111*a* and 112*a* of the stepped portions 111 and 112 are arranged along the inside wall of the plate 11 sequentially in the order from small to large, so the tool set of the present disclosure uses the center portion of the plate 11 to implement functions of wrench holes, and has advantages of easy carry, reduced volume and improved convenience.

In addition, the shape and size of the through hole 110 are defined by the plurality of wrench holes S, so the through hole 110 has a contour similar to a parallelogram and a part of the contour is in an irregular shape, which is a stepped serrate shape. Therefore, in order to tightly engage the fixing device 12 in the through hole 110, the structure of the fixing device 12 must be design particularly. Please refer back to FIGS. 1 through 3. In present embodiment, the fixing device 12 is further divided into an upper member 121 and a lower member 122. A bottom of the upper member 121 is jointed with a top of the lower member 122, a front end of the lower member 122 is more protruding than that of the upper member 121, and a rear end of the upper member 121 is more protruding than that of the lower member 122, such that when the fixing device 12 is engaged in the through hole 110, the top of the upper member 121 is pressed against the second flat portion 114, and the bottom of the lower member 122 is pressed against the first flat portion 113.

Please refer back to FIGS. 1 through 4. The fixing device 12 has a first engagement slot 123 and a second engagement slot 124 respectively recessed on the top and bottom thereof in a longitudinal direction. Therefore, the first and second engagement slots 123 and 124 can be engaged into the inside wall of the plate 11 facing the through hole 110 by a deformation manner, that is, the fixing device 12 is at least engaged on the first and second flat portions 114 and 113, such that the fixing device 12 can be fixed with the plate 11. In present embodiment, structures of the first and second engagement slots 123 and 124 are in stepped shapes (in present embodiment, the structure of the second engagement slot 124 is the same as that of the first engagement slot 123), such that the first engagement slot 123 can be pressed against the joint position between the first stepped portion 111 and the second flat portion 114, and the second engagement slot 124 can be pressed against the joint position between the second stepped portion 112 and the first flat portion 113.

In aforesaid embodiment, the plurality of wrench holes S are used to engage different dimensions of nuts 14, respectively. The plate 11 further has a fixing hole 117 for engaging the plurality of screwdrivers 13 and facilitating the user to apply force. The number and dimension of the fixing hole 117 can be adjusted by the manufacturer upon demand.

In the present disclosure, the through hole 110 is disposed in the center portion of the plate 11, and the manufacturer can dispose other types of tools on an outer periphery portion of the plate 11, for example, the rear end of the plate 11 can be extended outwardly to form a crowbar 115, or a part of the plate 11 can be extended outwardly to form a front sight adjustment tool 116, or a wire hook, an abrasive, a bottle opener, a screwdriver and so on.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A multifunctional tool set, comprising:

a plate, having a through hole cut through a middle portion thereof, a first stepped portion, a second stepped portion, a first flat portion and a second flat portion formed on inside wall of the through hole, wherein the front and rear ends of the first and second stepped portions are jointed with the first and second flat portions respectively, the first stepped portion corresponds in position to the first flat portion and the second stepped surface corresponds in position to the second flat portion, so that the through hole has a hole diameter gradually increasing from the front and rear ends thereof to a center portion thereof, and the first stepped portion is formed with a plurality of stepped parts which are sequentially jointed in an order from small to large, and the first stepped parts are in parallel with the first flat portion, so as to form different metric dimensions of wrench holes between the first stepped parts and the first flat portion, respectively, and the second stepped portion is formed with a plurality of second stepped parts which are sequentially jointed in an order from small to large, the plurality of second stepped parts are in parallel with the second flat portion, so as to form different imperial dimensions of wrench holes between the plurality of second stepped parts and the second flat portion;

a fixing device formed by elastic material and having a plurality of assembly holes cut therethrough and in parallel with each other, and a structure of the fixing device matching with that of the plurality of through holes, so as to enable the fixing device to be mount in the through hole by a deformation manner, and to expose the plurality of assembly holes out of the through hole, and wherein the fixing device includes an upper member and a lower member, a bottom of the upper member is jointed with a top of the lower member, and a front end of the lower member is more protruding than a front end of the upper member; and a plurality of screwdrivers having sectional structures respectively matching with the plurality of assembly holes of the fixing device, so as to be mounted into the plurality of assembly holes and positioned in parallel with both sides of the plate and adjacent to the through hole.

2. The multifunctional tool set according to claim 1, wherein the rear end of the upper member is more protruding than the rear end of the lower member, and when the fixing device is mounted and fixed into the through hole, a top of the upper member is pressed against the second flat portion, and a bottom of the lower member is pressed against the first flat portion.

3. The multifunctional tool set according to claim 2, wherein the fixing device has a first engagement slot and a second engagement slot respectively recessed on a top and a bottom thereof and extended along a longitudinal direction, and under a condition that the fixing device is deformed, the fixing device is fixed on the plate by respectively engaging the first and second flat portions with the first and second engagement slots.

4. The multifunctional tool set according to claim 3, wherein each of the first and second engagement slots has a stepped structure, to enable the first engagement slot to press against a joint position between the first stepped portion and the second flat portion, and the second engagement slot to press against a joint position between second stepped portion and the first flat portion.

5. The multifunctional tool set according to claim 4, wherein the rear end of the plate is extended outwardly to form a crowbar.

6. The multifunctional tool set according to claim 5, wherein the plate is extended outwardly to form a front sight adjustment tool.

* * * * *